US005654129A

United States Patent [19]

Taylor

[11] Patent Number: 5,654,129

[45] Date of Patent: Aug. 5, 1997

[54] METHOD FOR CLEANING ACETATE-BASED PHOTOGRAPHIC FILM WITH TRANS-DICHLOROETHYLENE

[76] Inventor: Timothy L. Taylor, 1335 Arabella #4, New Orleans, La. 70115

[21] Appl. No.: 419,658

[22] Filed: Apr. 12, 1995

Related U.S. Application Data

[63] Continuation-in-part of Ser. No. 202,592, Feb. 28, 1994, abandoned.

[51] Int. Cl.[6] ..... G03C 5/00; G03C 5/44

[52] U.S. Cl. ..... 430/347; 134/64 P; 134/40

[58] Field of Search ..... 430/347; 134/40, 134/64; 15/97.1, 100

[56] References Cited

U.S. PATENT DOCUMENTS

| | | | |
|---|---|---|---|
| 3,615,814 | 10/1971 | Ott et al. | 134/64 |
| 3,635,762 | 1/1972 | Ott et al. | 15/100 |
| 3,737,941 | 6/1973 | Miller et al. | 15/100 |
| 3,882,568 | 5/1975 | Hill | 15/100 |
| 4,086,179 | 4/1978 | Schneider | 252/171 |
| 5,250,208 | 10/1993 | Merchant et al. | 134/40 |

*Primary Examiner*—Geraldine Letscher
*Attorney, Agent, or Firm*—C. Emmett Pugh; Pugh/Associates

[57] ABSTRACT

Trans-dichloroethylene is used in a pure or in a blended state as a cleaning agent for all acetate-based photographic films. In manual cleaning procedures of still-photography and motion-picture films, a soft, lint-free material is moistened with trans-dichloroethylene, or a blend containing trans-dichloroethylene, and then used to buff the film. The most favorable blend discovered contains 50% trans-dichloroethylene, 50% perchloroethylene. In mechanized cleaning procedures of motion-picture films, it is anticipated that trans-dichloroethylene, or a blend containing trans-dichloroethylene, can be used as the cleaning agent with little or no modification to the existing machines. Trans-dichloroethylene can serve as an effective, non-ozone depleting replacement for 1,1,1-trichloroethane in all film-cleaning applications.

11 Claims, No Drawings

METHOD FOR CLEANING ACETATE-BASED PHOTOGRAPHIC FILM WITH TRANS-DICHLOROETHYLENE

This application is a continuation-in-part of U.S. patent application Ser. No. 08/202,592, filed Feb. 28, 1994, now abandoned and entitled "METHOD FOR CLEANING ACETATE-BASED PHOTOGRAPHIC FILM WITH TRANS-DICHLOROETHYLENE."

TECHNICAL FIELD

The present invention relates generally to the use of the chlorinated solvent trans-dichloroethylene, and more particularly to its use as a non-ozone depleting cleaning agent for acetate-based still-photography and motion-picture films.

BACKGROUND ART

Nearly all photographic films, whether still-photography or motion-picture, share the same basic composition, namely an emulsion layer, containing photosensitive silver-halide particles, spread upon one side of an acetate base material. In either negative-image or positive-image films, and in all still-photography or motion-picture film formats, this basic emulsion layer/acetate base composition is essentially the same.

Since films are designed to project an image as light passes through them, it is important to the quality of the projected image that the film surface be free of contaminants. Some of the commonest contaminants are dust, lint and fingerprints. It is especially crucial to remove these contaminants from negatives, which must serve as masters for potentially numerous positive-image prints.

Certain chlorinated solvents have proven themselves the most effective photographic film cleaning agents because they dissolve oils well and then evaporate quickly. These characteristics reduce the need for repeated buffing of the film, whether to remove contaminants or to dry unevaporated cleaning agents. The most widely used solvent for cleaning photographic films, both privately and commercially, is the chlorinated solvent 1,1,1-trichloroethane, through processes that may be either manual or mechanized. Because of its harmfulness to the ozone layer, however, 1,1,1-trichloroethane is currently being eliminated from the film-cleaning market, both retail and wholesale. No other solvent as effective for cleaning film as 1,1,1-trichloroethane has been introduced as a replacement. There is thus a need for an effective replacement for 1,1,1-trichloroethane that is not harmful to the ozone layer.

DISCLOSURE OF THE INVENTION

The invention described herein relates to the use of trans-dichloroethylene as a cleaning agent for all photographic films on an acetate base material. This includes both still-photography and motion-picture films. Trans-dichloroethylene, whether pure or blended with another suitable miscible liquid, can work effectively in all film-cleaning applications, either manual or mechanized. Trans-dichloroethylene has the advantage over 1,1,1-trichloroethane, currently the most widely used film-cleaning agent, in that it is not harmful to the ozone layer. Trans-dichloroethylene can serve as a non-ozone depleting replacement for 1,1,1-trichloroethane in any film-cleaning application, and it can clean photographic films more effectively than any solvent currently in use for photographic film-cleaning.

In accordance with this invention a method for cleaning acetate-based photographic film with trans-dichloroethylene is provided. The method includes the step of lightly buffing said film with a lint-free material that has been moistened with a cleaning agent comprising a non-azeotropic mixture including trans-dichloroethylene. Optimally, the mixture will also include perchloroethylene. Best results were found at proportions of trans-dichloroethylene and perchloroethylene of between nine parts trans-dichloroethylene to one part perchloroethylene, and one part trans-dichloroethylene to nine parts perchloroethylene by volume.

In view of the foregoing, several advantages of the present invention are readily apparent. A method for cleaning acetate-based photographic film with trans-dichloroethylene is provided. This method does not harm the ozone, as have previous methods using 1,1,1-trichloroethane. Further, when trans-dichloroethylene is mixed in selected proportions with perchloroethylene, the resulting blend is significantly more effective than either of the two ingredients alone in cleaning film. This blend also has significant cleaning advantages when compared to 1,1,1-trichloroethane. Still further, the blend of trans-dichloroethylene and perchloroethylene may be adjusted to change the cleaning qualities of the blend by varying the proportions of the two ingredients. For example, the cleaning strength may be made stronger or weaker, and the evaporation speed of the blend may be increased or decreased, in order to best accommodate a given situation.

Additional advantages of this invention will become apparent from the description which follows.

BEST MODE FOR CARRYING OUT THE INVENTION

Trans-dichloroethylene is a chlorinated solvent having properties which make it suitable for cleaning photographic films. These properties are: 1) Its high solvency power 2) Its comparatively high vapor pressure 3) Its low toxicity 4) Its zero ozone depletion potential. In tests conducted by the inventor, trans-dichloroethylene proved effective in numerous film-cleaning tests. In these tests the solvent was applied to still-photography negatives, to positive-image still-photography slides, and to negative and positive-image motion-picture films.

The inventor conducted all film-cleaning tests manually. For still-photography negatives and slides, his methods entailed lightly buffing the films with a soft, lint-free material that had been moistened with the solvent. This is the basic procedure used by all still-photography film-processors, both privately and commercially. For motion-picture films, the inventor's methods entailed winding film manually between two reels approximately three feet apart while lightly grasping the film in a velvet mitten or a lint-free cloth that had been moistened with the solvent. This procedure is commonly employed privately (by the film-student, for example), and it is effective for relatively infrequent cleanings of small quanitities of film (up to 500feet). However, it is impractical for commercial applications, where thousands of feet of film might need to be cleaned in a short time. All commercial film-cleaning is done with sophisticated machines, the vast majority of which use 1,1,1-trichloroethane as the cleaning agent. Though it was not possible to test trans-dichloroethylene in one of these commercial film-cleaning machines, it is anticipated that trans-dichloroethylene will work in an effective, if not superior manner to 1,1,1-trichloroethane. An explanation of a proposed method for modifying these machines to work with trans-dichloroethylene is contained further on.

Every test was conducted comparatively, where identical procedures were used to clean identically contaminated films. The contaminants were normal ones: fingerprints and naturally occurring dust and lint that had settled onto the film surfaces. In every procedure, first trans-dichloroethylene was tested, then 1,1,1-trichloroethane, then perchloroethylene, then isopropyl alcohol, and finally secondary butyl alcohol. Except for trans-dichloroethylene and secondary butyl alcohol, all these solvents are commonly used to clean films. Isopropyl alcohol is used almost exclusively by non-professionals, as it is relatively ineffective, but inexpensive and easily accessible. To the inventor's knowledge, perchloroethylene is used only by professionals in the mechanized cleaning of motion-picture films. 1,1,1-trichloroethane is by far the most widely used of these solvents for cleaning both still-photography and motion-picture films, privately or commercially, manually or mechanized.

Due to their relatively weak solvency powers and slow evaporation rates, perchloroethylene and all the alcohols tested proved vastly inferior to trans-dichloroethylene or 1,1,1-trichloroethane for cleaning films. In manual procedures, these less effective solvents tended to leave pronounced residual marks on the films, and they were so slow to evaporate as to be impractical.

Since 1,1,1-trichloroethane is the most effective of all currently used film-cleaning agents, the inventor sought primarily to match or better its cleaning abilities with trans-dichloroethylene. In every test conducted, pure trans-dichloroethylene proved to be in some way superior to 1,1,1-trichloroethane. It was a more efficient cleaning-agent because of its greater solvency power and higher evaporation rate. The greater solvency power of trans-dichloroethylene made it possible to clean film with less buffing, thus eliminating the potential for abrasion of the film surface by the buffing material. The higher evaporation rate made the film cleaning faster, as no drying time was required. Furthermore, since the trans-dichloroethylene evaporated nearly on contact, contaminants were caught and retained in the buffing material, and not in the droplets of solvent that remained on the film, as was the case with all the other solvents tested. Consequently, trans-dichloroethylene was much less inclined to leave residual marks on the film than 1,1,1-trichloroethane or any other cleaning agent tested.

With repeated buffing, however, trans-dichloroethylene proved too powerful a cleaning agent, and caused slight visible damage to the film surface in the form of minute scratches where the moistened buffing material abrased the film surface. Depending on the buffing material (cotton-tipped swabs, cotton balls, velvet cloth and lint-free lens cloth were used), it took anywhere from two to five times as many buffs with 1,1,1-trichloroethane to visibly damage the film. However, repeated buffings are inadvisable for any film-cleaning procedure using any cleaning agent, as they increase the chances for abrasion of the film surface. Furthermore, repeated buffings are largely unnecessary with trans-dichloroethylene, since one buff with this cleaning agent accomplishes what roughly three buffs with 1,1,1-trichloroethane accomplish.

Nevertheless, the inventor tested several different blends of trans-dichloroethylene with other solvents in order to reduce its solvency potential. A 50% trans-dichloroethylene, 50% perchloroethylene blend proved optimal for cleaning films without damaging them, even after repeated buffings. One great advantage of blending trans-dichloroethylene with perchloroethylene was that the latter tended to spread more evenly over the film surface, thus evenly distributing the primary cleaning agent, trans-dichloroethylene. The two solvents were thus highly compatible as a blend for film cleaning for the following reasons: 1) Trans-dichloroethylene's solvency power was reduced when mixed with perchloroethylene, making it gentler for film cleaning 2) perchloroethylene helped to spread the trans-dichloroethylene evenly over the film surface 3) trans-dichloroethylene, with a tolerance level of 200 ppm, helps reduce the toxicity of perchloroethylene, which has a tolerance level of 50 ppm 4) perchloroethylene lowers the vapor pressure of trans-dichloroethylene, thus rendering the blend less volatile.

Though the trans-dichloroethylene/perchloroethylene blend evaporates more slowly than 1,1,1-trichloroethane, it may be used in such a way as to render it even more effective than 1,1,1-trichloroethane as a film-cleaning agent for still-photography negatives. The inventor discovered that, if the blend is applied to the film, and then lightly removed with a dry, lint-free cloth, more contaminant is removed, especially fingerprints on the emulsion-side of the film, than 1,1,1-trichloroethane was able to remove. The emulsion-side of film is particularly susceptible to contamination by fingerprints, as it is softer and more textured than the non-emulsion side. Fingerprints on the emulsion layer are virtually impossible to remove, and they can render the negative practically useless for printing. Pure trans-dichloroethylene removes more fingerprint contamination from the emulsion side than does 1,1,1-trichloroethane. However, the blend of trans-dichloroethylene and perchloroethylene, used in the method described above, removes virtually all fingerprint contamination from this emulsion layer, something no other cleaning agent, blended or unblended, was able to accomplish. Thus, trans-dichloroethylene, either pure or blended with perchloroethylene, proves to be a superior still-photography film-cleaning agent to 1,1,1-trichloroethane or any other known solvent.

Finally, it is anticipated that trans-dichloroethylene will make an effective, if not superior replacement for 1,1,1-trichloroethane in all commercial motion-picture film cleaning applications. Such cleaning is done by machine (the most common being an ultrasonic cleaning machine, such as the model CF3000 MK VI as manufactured by Lipsner-Smith). This method includes subjecting the film to ultrasonic cavitation in a bath of a cleaning agent comprising a non-azeotropic mixture including trans-dichloroethylene followed by rinsing said film with a filtered rinse of said cleaning agent. Since film-cleaning machines operate using a "Virtually Closed System" wherein nearly all solvent vapors are contained within the machine, dangers of solvent toxicity to humans are minimal. Nevertheless, since 1,1,1-trichloroethane is currently being phased out of the film-cleaning market, commercial film-cleaning facilities are desperate for replacement solvents. Trans-dichloroethylene, or a blend of trans-dichloroethylene and perchloroethylene, could effectively replace 1,1,1-trichloroethane in all machines currently using the latter as a cleaning agent. Though trans-dichloroethylene is slightly more flammable than 1,1,1-trichloroethane, these machines could be easily and inexpensively modified using a nitrogen pad so that a fire within the cleaning compartment would be virtually impossible. A blend of trans-dichloroethylene and perchloroethylene could mimic the solvency power and vapor pressure of 1,1,1-trichloroethane, thus rendering these machines useful for years to come with little to no modification. In the case of a blend, the low vapor pressure of perchloroethylene would effectively counter the slight flammability of trans-dichloroethylene.

Test 1

The following scale to rate the efficacy of various cleaning solvents for removing finger prints from a contaminated 35 mm negative was devised; the scale is from 1 to 5, 1 representing the poorest cleaning, and 5 the best. The objective of the test was to rate cleaning ability of solvents and blends according to this scale.

The following Method was used: A strip of negative (35mm) 3 frames long, was contaminated with finger prints. The entire strip was smudged with prints, then swiped with a cotton-tipped swab in a single line. In this way, the results were easy to observe, and there was no disparity in contamination, or in character/condition of the negative. The swab was dipped in the respective cleaning agent to be tested and the test was performed as described. Test results are depicted below.

TEST 1

RESULTS

| | |
|---|---|
| 1,1,1 | removed all contamination, with neat edges |
| trans-dichloroethylene | removed contamination, but appeared less sharp at edges |
| perchloroethylene | removed contamination, but was less sharp at edges |
| 50/50 trans-dichloroethylene/ perchloroethylene | removed contamination, neat edges. |

From the foregoing test, certain conclusions may be drawn. 1,1,1, trans-dichloroethylene and perchloroethylene all serve as excellent film cleaning agents. 1,1,1 is the best of the pure solvents. Trans-dichloroethylene evaporates so quickly that it doesn't stay on the swab long enough to be transferred to the negative. Perchloroethylene is weaker, hence the lesser sharpness around the edges.

Test 2

A second test was performed which was similar to the previous test, but employing a different method. The method was to contaminate a negative with fingerprints, then to remove contaminant by wetting the negative with solvent, applied with cotton-tip swab. Then, the solvent was dried off using a cotton ball. The test results are as depicted below.

TEST 2

RESULTS8

| | |
|---|---|
| trans-dichloroethylene | Failed. Solvent dries too quickly. Never has time to remain on negative long enough that removing/drying it applies. Also, appears to smear oils and damage negative. |
| 1,1,1 | Removes nearly all contaminants, but dries too quickly to really warrant drying of cotton ball. Leaves slight oily residue in very thin streaks. |

-continued

| | |
|---|---|
| perchloroethylene | Remained on negative, then was easily removed with a cotton ball. Removed all contaminant. Left significant static charge. |
| trans-dichloroethylene/ perchloroethylene 50/50 | Removed all contaminant. static charge. |

Ratings on a scale of 1 to 5 (5 being best):
Trans-dichloroethylene = 1
1,1,1 = 3
Perchloroethylene = 4
Perchloroethyene\Trans-dichloroethylene 50/50 = 5

From the date of Test 2, several conclusions may be drawn. Perchloroethylene is an essential component to an effective film cleaning agent in Test 2 because it sits on film long enough to break up oils and then can be removed carrying oils away with it. However, this method of cleaning tends to create a static charge because plastic film is being buffed with cotton. Perchloroethylene is the worst one to create a charge for reasons that are unknown. The trans-dichloroethylene/perchloroethylene blend doesn't leave as much of a charge. (Charge is indicated when cleaned negative "sticks" to the cleaning surface, in this case paper.) Trans-dichloroethylene is ineffective as it evaporates too quickly and thus can't be wiped away. In addition, pure trans-dichloroethylene tends to dissolve film. 1,1,1 is similar in this regard. Also, it doesn't sit on film long enough to break down oils. On Test 2, perchloroethylene and trans-dichloroethylene/perchloroethylene are the best at removing contaminant. The blend is rated higher because of the lesser static charge. Static charge is undesirable as it attracts dust. The wiping with a dry cloth could create the charge, however. It is not an applicable procedure with trans-dichloroethylene or 1,1,1.

Test 3

A third test was performed using the following method: A strip of negative was contaminated with fingerprints and then cleaned with 1,1,1 and various blends of trans-dichloroethylene/perchloroethylene. The cleaning method employed was to moisten the surface of the negative with a cotton-tipped swab, then dry with a cotton ball, if necessary (it has already been determined that any procedure where drying takes place by means of a drying material (vs. air) removes more contaminant than without). The emulsion side of the negative was tested, the harder side to clean. Negatives were also cleaned with pure solvents (trans-dichloroethylene and perchloroethylene for comparison). All were rated to scale. Results of Test 3 are depicted below.

TEST 3

RESULTS

Ratings were as follows, on a scale of 1 to 5:

| Pure Solvents | Rating |
|---|---|
| 1,1,1-trichloroethane | 1 |
| perchloroethylene | 2 |
| trans-dichloroethylene | 3 |

Blend of trans-dichloroethylene/perchloroethylene (T/P):

| % (T/P) (by volume) | Rating |
|---|---|
| 90/10 | 5 |
| 80/20 | 5 |
| 70/30 | 5 |
| 60/40 | 5 |
| 50/50 | 5 |
| 40/60 | 5 |
| 30/70 | 5 |
| 20/80 | 4 |
| 10/90 | 4 |

From Test 3, several conclusions may be drawn. Clearly, blends of trans-dichloroethylene/perchloroethylene proved optimal for removing finger prints from the non-emulsion side of film. Again, fingerprints could not be entirely removed with any solvent or blend from the emulsion side because it is textured and fingerprints possibly imprint into the emulsion. Still, any blend of trans-dichloroethylene/perchloroethylene proved superior, because the perchloroethylene served as an agent for delivering trans-dichloroethylene to the film contaminant. This cleaning method works best when solvent has time to settle on and dissolve oils. 1,1,1-trichloroethane evaporates too quickly to be effective in this test. Trans-dichloroethylene also evaporates too quickly, but the sheer potency of the solvent breaks up oils better than any other pure solvent. Its lower vapor pressure and consequent slower evaporation allows perchloroethylene to settle into the surface of the film well; however, it doesn't have the power to dissolve oils as well as other solvents. Any blend of perchloroethylene/trans-dichloroethylene worked very well because perchloroethylene delivers the primary solvent, trans-dichloroethylene, into the oily contaminant. When trans-dichloroethylene reaches 80% concentration or higher, efficacy of cleaning is reduced because the vapor pressure of the blend becomes higher, and the blend evaporates too quickly.

While tests were conducted on pure blends of trans-dichloroethylene and perchloroethylene containing no other ingredients, in practice it is anticipated that other miscible ingredients may be added to the mixture, for various purposes. For example, an anti-static agent may be added to inhibit static charge build-up, as is currently done with commercial applications of 1,1,1-trichloroethane. Likewise, a lubricant may be added to the mixture to improve the spreading qualities. Finally, other solvents or alcohol may be added to the mixture, either to alter the qualities of the mixture slightly or simply to reduce the price thereof. Therefore, it is important to keep in mind that the qualities discerned in the foregoing tests are attributable to the ratio of trans-dichloroethylene to perchloroethylene and not necessarily the respective percentages of the whole mixture which are represented by trans-dichloroethylene and perchloroethylene. For example, a blend of four parts trans-dichloroethylene to one part perchloroethylene will typically impart the same qualities discerned by the tests for 80/20 blends, even if the mixture is "cut" with 10% of other commonly used ingredients.

Trans-dichloroethylene is an excellent film-cleaning agent and a suitable and needed replacement for 1,1,1-trichloroethane. It is environmentally expedient since it has an ozone depletion potential of "0." 1,1,1-trichloroethane is being taken off the market because it is harmful to the ozone layer; trans-dichloroethylene can perform the same film-cleaning functions as well or better with no danger to the ozone layer.

Additionally, tests of trans-dichloroethylene/perchloroethylene blends show that such mixtures are superior to 1,1,1-trichloroethane for cleaning film, in the range from 10% trans-dichloroethylene and 90% perchloroethylene to 90% trans-dichloroethylene and 10% perchloroethylene. The greatest advantages were found when at least 30% trans-dichloroethylene was utilized in the mixture. Further, to meet the demands of a given cleaning situation, the qualities of the mixture may be varied easily by varying the proportions of the ingredients. For example, a stronger cleaning action generally may be achieved by increasing the trans-dichloroethylene content of the mixture, while a better spreading action may generally be achieved by increasing the perchloroethylene content. Finally, since neither trans-dichloroethylene nor perchloroethylene is harmful to the ozone, it is reasonably expected that a mixture of two will not be harmful to the ozone either.

This invention has been described in detail with reference to a particular embodiment thereof, but it will be understood that various other modifications can be effected within the spirit and scope of this invention.

I claim:

1. A method for cleaning acetate-based photographic film comprising the step of lightly buffing said film with a lint-free material that has been moistened with a cleaning agent comprising a non-azeotropic mixture including trans-dichloroethylene.

2. A method for cleaning acetate-based photographic film according to claim 1 wherein said cleaning agent further comprises perchloroethylene.

3. A method for cleaning acetate-based photographic film according to claim 1 wherein said cleaning agent further comprises an alcohol compound.

4. A method for cleaning acetate-based photographic film according to claim 1 wherein said cleaning agent further comprises a miscible cleaning liquid.

5. A method for cleaning acetate-based photographic film comprising the steps of subjecting said film to ultrasonic cavitation in a bath of a cleaning agent comprising a non-azeotropic mixture including trans-dichloroethylene followed by rinsing said film with a filtered rinse of said cleaning agent.

6. A method for cleaning acetate-based photographic film according to claim 5 wherein said mixture further comprises perchloroethylene.

7. A method for cleaning acetate-based photographic film according to claim 5 wherein said cleaning agent further comprises an alcohol compound.

8. A method for cleaning acetate-based photographic film according to claim 5 wherein said cleaning agent further comprises a miscible cleaning liquid.

9. A method for cleaning acetate-based photographic film according to claim 6 wherein said trans-dichloroethylene and said perchloroethylene are present in proportions of between nine parts trans-dichloroethylene to one part perchloroethylene, and one part trans-dichloroethylene to nine parts perchloroethylene by volume.

10. A method for cleaning acetate-based photographic film comprising the step of lightly buffing said film with a lint-free material that has been moistened with a cleaning agent comprising a non-azeotropic mixture including trans-dichloroethylene and perchloroethylene in proportions of between nine parts trans-dichloroethylene to one part perchloroethylene, and one part trans-dichloroethylene to nine parts perchloroethylene by volume.

11. A method for cleaning acetate-based photographic film according to claim 10, wherein said trans-dichloroethylene and said perchloroethylene are present in proportions of between nine parts trans-dichloroethylene to one part perchloroethylene, and three parts trans-dichloroethylene to seven parts perchloroethylene by volume.

* * * * *